US006070366A

United States Patent [19]

Pierson

[11] Patent Number: 6,070,366

[45] Date of Patent: Jun. 6, 2000

[54] AIR SUPPORTED ENCLOSURE AND METHOD OF ASSEMBLY

[76] Inventor: Robert M Pierson, 154 W. Prospect St., Hudson, Ohio 44236

[21] Appl. No.: 09/224,749

[22] Filed: Jan. 4, 1999

[51] Int. Cl.[7] ..... E04B 1/34

[52] U.S. Cl. ..... 52/2.17; 52/2.24; 52/2.26

[58] Field of Search ..... 52/21.11, 2.17, 52/2.19, 2.24, 2.25, 2.26; 47/26, 28.1, 21

[56] References Cited

U.S. PATENT DOCUMENTS

| | | | |
|---|---|---|---|
| 3,638,368 | 2/1972 | Pierson | 52/2 |
| 3,661,693 | 5/1972 | Pierson | 161/101 |
| 3,762,108 | 10/1973 | Pierson | 52/2 |
| 3,816,885 | 6/1974 | Saether | 24/243 K |
| 4,028,853 | 6/1977 | Hickey | 52/2 |
| 4,477,503 | 10/1984 | Fraioli | 428/102 |
| 5,311,699 | 5/1994 | Huffman | 47/26 |

*Primary Examiner*—Michael Safavi

*Attorney, Agent, or Firm*—Paul E Milliken; Ray L Weber; Lee A Germain

[57] ABSTRACT

A lightweight flexible air supported enclosure which may be used as a shelter for covering storage areas, greenhouses and various other uses which may be erected inexpensively on site from strips of flexible sheet material attached together at seams using adjacent pairs of reinforcing cords or cables with the seams being sealed by internally hanging edge flaps of the sheet material. The seal is created by the flaps being held in surface to surface contact by the internal pressure of the envelope. This enclosure is especially suited for assembly on uneven surfaces without preparing the surface of the perimeter on which the enclosure is to be mounted. The on-site assembly is achieved by deploying from rolls, horizontal strips of flexible material in parallel side by side relationship with each strip having a flexible reinforcing member under the bottom surface of the strip and spaced inwardly from each side edge in such in such manner as to permit downwardly hanging seal flaps from each edge which provide the means for retaining inflation air.

15 Claims, 7 Drawing Sheets

AIR SUPPORTED ENCLOSURE AND METHOD OF ASSEMBLY

FIELD OF THE INVENTION

This invention relates to an air supported enclosure which may be used as a shelter for covering storage areas, greenhouses and various other uses. More specifically it is an inexpensive shelter erectable on site from strips of flexible sheet material attached together at seams using adjacent pairs of reinforcing cords or cables with the seams being sealed by internal hanging edge flaps of the sheet material. This enclosure is especially suited for assembly on uneven surfaces without preparing the perimeter on which the enclosure is to be erected.

BACKGROUND OF THE INVENTION

Most types of inflatable air supported buildings or enclosures are known in the prior art. Many of these inflatable buildings are made from fabric, plastic or other flexible sheet material reinforced by cables or other elongated flexible members. In many instances, the flexible material is non-extensible although some buildings may use extensible material. Many of the prior inflatable build structures derive their technology from airship design such as that used in the envelopes of blimps. Such envelopes required high strength seams tightly sealed together to prevent loss of inflation gas pressure.

The present invention, on the other hand, is intended to be far "looser" at the seam joints. The strips of envelope material are deliberately attached together at only spaced apart locations along the seams in order to provide more relative movement between the strips when subjected to violent weather conditions at any given moment. This permits the envelope to adjust to varying pressures on certain specific zones in the envelope regardless of the pressure on the other zones of the envelope. The seams of the envelope of this enclosure are sealed by hanging internal flaps held in surface to surface contact by the internal pressure on the envelope rather than by adhesive or stitches as in the conventional envelope. This distinction is uniquely inherent in the present design.

In conventional air structures, blowers maintain internal pressures which, at a given moment, are the same throughout the enclosure. However, wind pressures impinging on large enclosures may vary over different zones, due to effects of nearby trees, buildings, topographic features, etc. This invention provides for maintaining constant pressure differentials ($\Delta p$'s) between local inside and outside pressures of zones throughout large enclosures, even where external storm wind loads may vary substantially over the enclosure as a whole.

Some of the closest prior art known to applicant are applicant's own U.S. Pat. Nos. 3,638,368 and 3,762,108 issued to R. M. Pierson which show cable reinforced inflatable buildings which may be constructed with internal tethering to enable the buildings to cover large areas while maintaining a certain proximity to the ground to withstand high winds.

The present invention differs from applicant's above prior patents in that it is designed for less expensive totally on site assembly and to have a different type of seal for the connections between strips of the flexible sheet material of the envelope.

OBJECTS OF THE INVENTION

An object of this invention is to provide an air supported enclosure which is lower in cost and which may be assembled substantially entirely on site on uneven surfaces without requiring preparation of the perimeter surface on which the enclosure is mounted.

Another object of the invention is to provide an air supported enclosure which can be operated at a much lower internal inflation pressure.

A still further object of the invention is to provide an air supported enclosure which operates using light weight blowers due to supplemental pressure control of tightening or loosening of the reinforcing cords of the enclosure.

An even further object of the invention is to provide an air supported enclosure which provides for ease of replacement of sections of the enclosure envelope if holes develop therein.

These and other objects of the invention will become more fully apparent from the description in the specification and accompanying drawings.

SUMMARY OF THE INVENTION

An air supported enclosure having its lower peripheral edges attached to a base comprising: a flexible cover envelope comprising elongated flexible sheets arranged in parallel adjacent relationship to each other to cover the entire area to be enclosed; a pair of parallel spaced apart flexible elongated reinforcing members attached to an inside surface of each sheet; each reinforcing member being positioned laterally inwardly a spaced distance from a corresponding side edge of the sheet so that a center portion of each sheet lies between the pair of reinforcing members and an excess width portion of each side edge of the sheet extends over and downwardly below the respective reinforcing member to form a substantially vertical flap; each sheet being positioned against an adjacent sheet with the adjacent vertical flaps in intimate contact with each other and the respective reinforcing members of each pair of adjacent flaps being in close proximity to each other separated by the two adjacent flaps; retaining means fastening together each pair of adjacent reinforcing members at spaced intervals along the length thereof to form seams between the adjacent sheets and hold each pair of adjacent flaps in contact with each other when air inflation pressure is introduced into the envelope of the enclosure; each end of the sheets and the reinforcing members being sealingly attached to the periphery of the base to form an airtight enclosure; an means supplying internal inflation pressure to the interior of the envelope in excess of atmospheric pressure; the internal pressure forcing together adjacent surfaces of the flaps to seal the seams between adjacent sheets.

DESCRIPTION OF THE PREFERRED EMBODIMENTS

Figure 1:
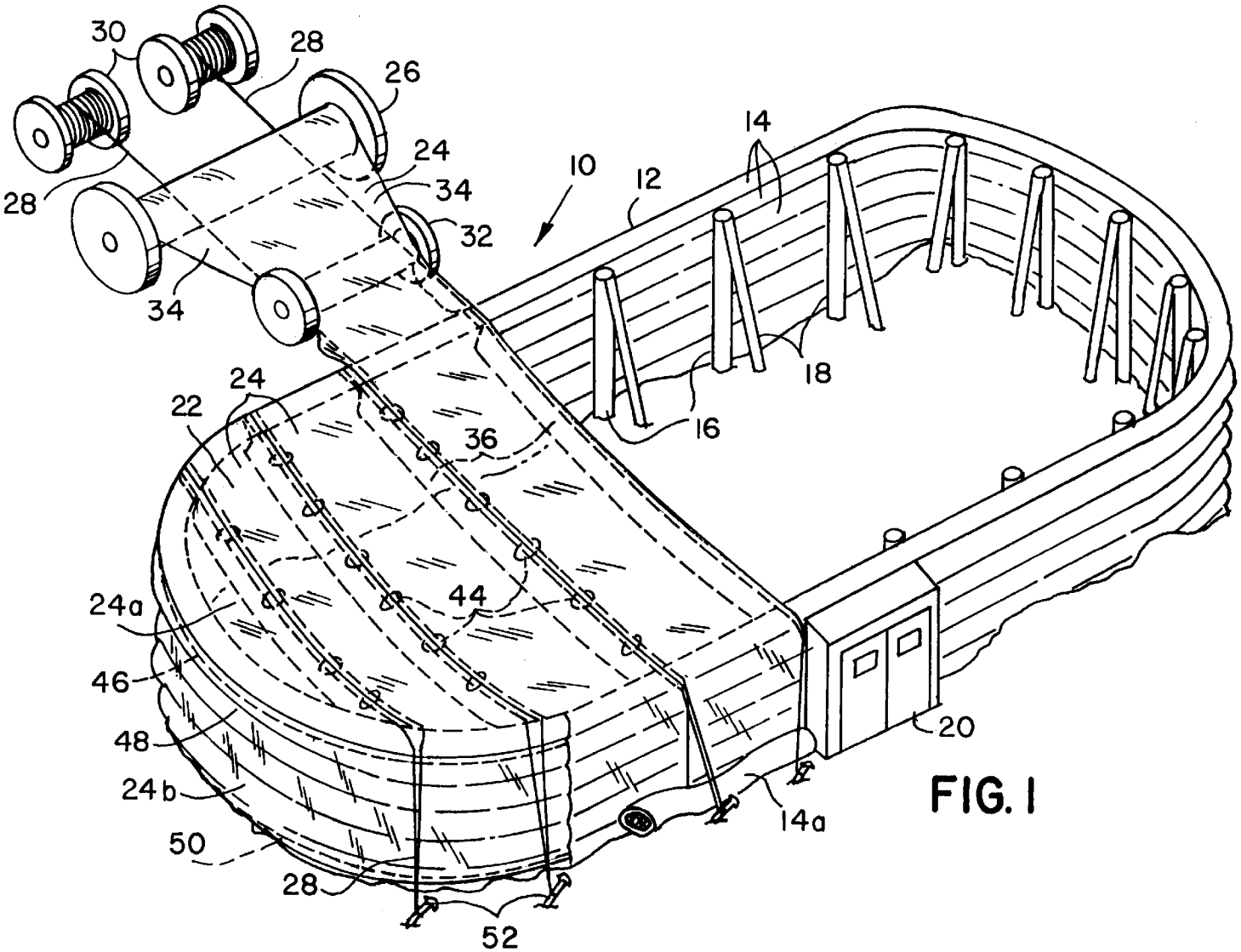
FIG. 1 is a perspective view of the enclosure of the invention in the process of being assembled on site.
Figure 2:
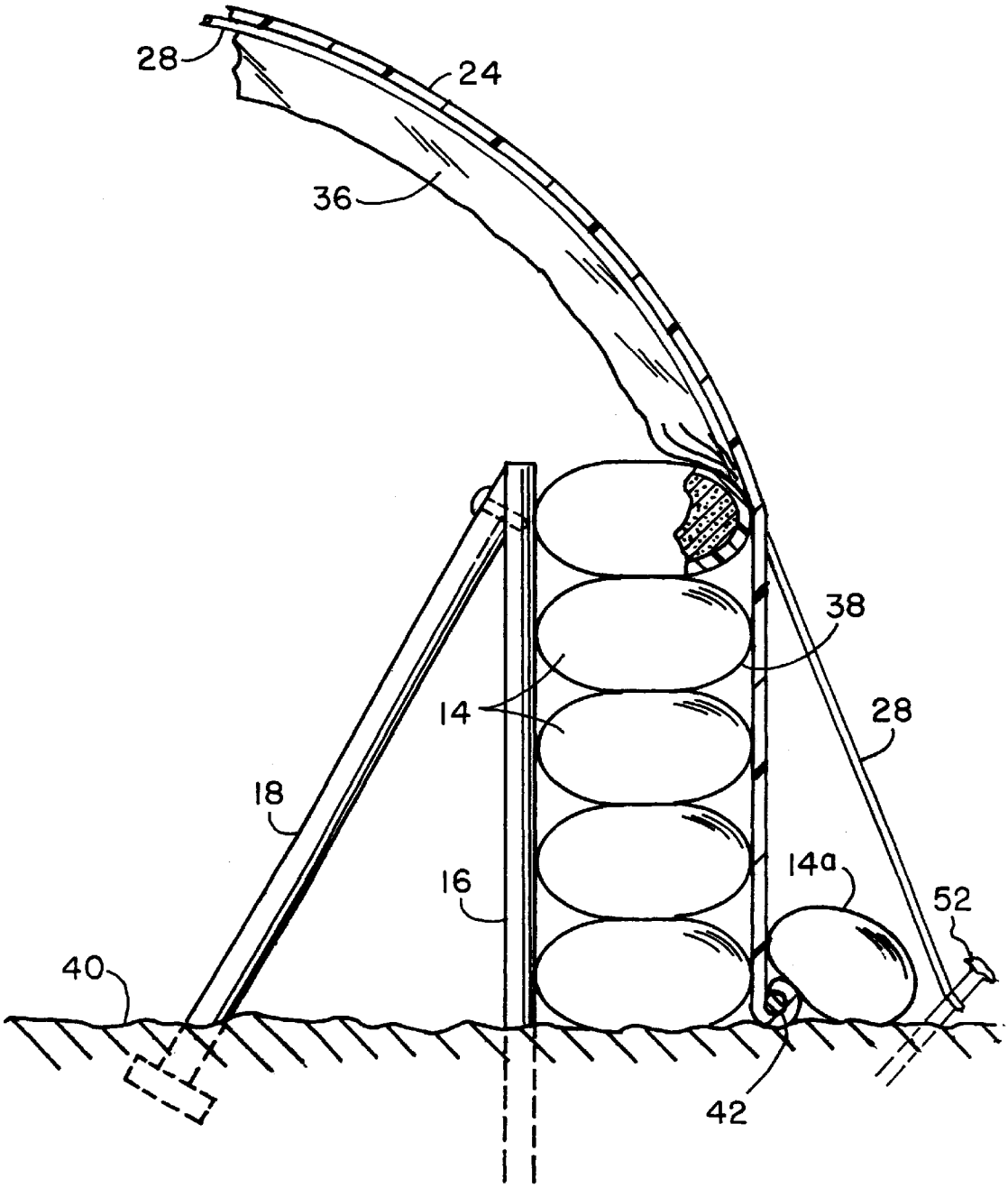
FIG. 2 is a fragmentary cross-sectional view taken on line 2—2 of FIG. 6 showing the construction details of the perimeter wall to which the cover envelope is attached and a portion of an inflated envelope.

Referring to FIGS. 1 and 2 of the drawings, an air supported enclosure is indicated as a whole by the numeral 10. Looking first at FIG. 1, an enclosure 10 is shown under construction with a perimeter wall 12 laid in position on a base such as the ground having an irregular grade level. The wall 12 is constructed of hollow flexible tubes 14 of plastic or fabric which are filled with loose material such as sand, gravel or other aggregate material having sufficient weight to provide stability to the wall.

To provide stability to the wall and hold the tubes 14 in stacked position, a series of vertical posts 16 and angled braces 18 are positioned at spaced apart locations around the inside of the wall. The arrangement of the posts 16 and braces 18 are shown in greater detail in enlarged cross-sectional view in FIG. 2. While not shown in this example, it is also possible to have such posts and braces on the outside of the wall 12 in certain enclosures depending upon whether the exterior posts are deemed to be needed, particularly in case of larger enclosures and higher walls.

The wall is provided with various access openings such as the doors 20 or other openings not shown for blowers, utility lines, and any other necessary equipment depending upon the needs of the particular enclosure. For simplicity the tubes 14 have not been shown to be any particular length, however, when constructing the wall, the tubes 14 should be of such length that when filled with filler material, the sections of tubes should be no longer that which can be readily positioned during the stacking of the tubes to construct the wall. When the wall 12 is in position on the site, a flexible envelope 22 is assembled above the wall 12 by horizontally pulling strips 24 of flexible sheet material from strip rolls 26. The strips 24 are preferably plastic and for most uses could be made of low cost plastic film such as polyethylene or plasticized PVC of a light gage of approximately 4 to 8 mils. Simultaneously a pair of spaced apart reinforcing members 28 such as cords or wires are pulled horizontally with the strips 24 lying beneath the strips a predetermined distance laterally inwardly of the edge of each strip 24. The strip 24 when passed through a narrowing roller 32 has its outer edges 34 folded downwardly over their respective cords 29 to form downwardly hanging flaps 36. Each of the strips 24 is positioned over the top of the wall 12 and drawn down each side 38 of the wall 12 to the ground 40 as shown in FIG. 2 where the end of each strip 24 is wrapped around a bottom retaining rope 42 which extends around the base of the wall 12 at the ground. An outer retaining tube 14*a* similar to the tubes 14 is laid against the end of the strips 24 and bottom retaining rope 42 to hold the end of the strips 24 against the wall and create a seal of the envelope 22 and hold the ends of the strips 24 in position when air is introduced into the envelope.

Figure 3:
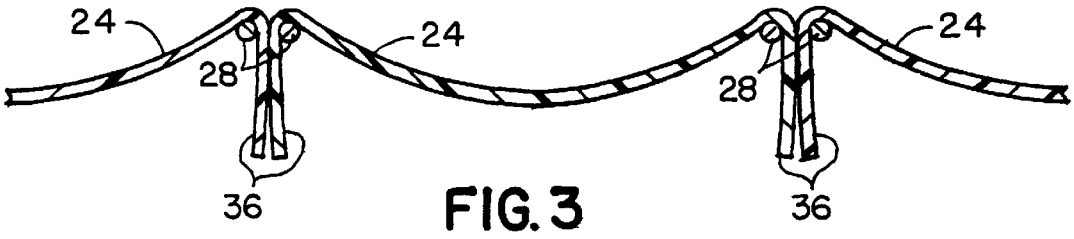
FIG. 3 is an enlarged fragmentary cross-sectional view showing a portion an uninflated cover envelope before the adjacent strips of cover envelope material have been fastened together at the seams.

As the strips 24 are being assembled over the wall 12 as shown in FIG. 1, the strips 24 take on the cross-sectional shape shown in FIG. 3 with the strips 24 lying on top of the reinforcing cords 28 (not yet inflated) and the outer lateral edges hanging down from the cords 28 to form pairs of adjacent hanging flaps 36.

Figure 4:
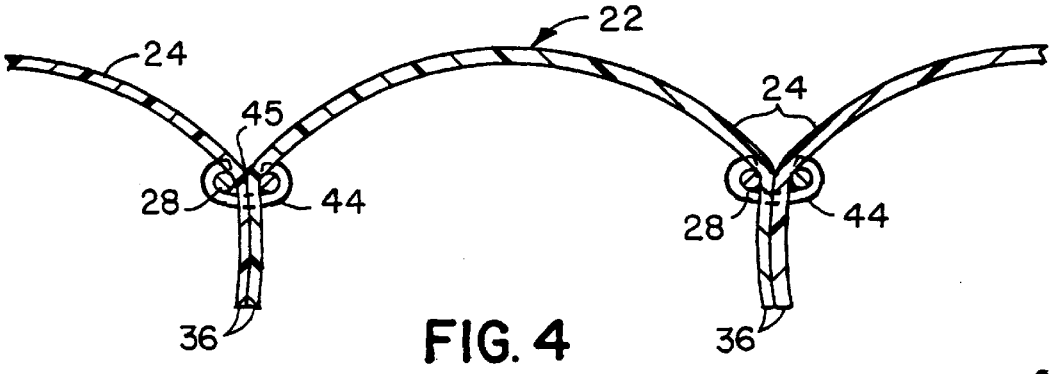
FIG. 4 is an enlarged fragmentary cross-sectional view similar to FIG. 3 after the adjacent strips of cover envelope material have been fastened together and the envelope has been inflated, FIG. 4 being taken on line 4—4 of FIG. 5.
Figure 5:
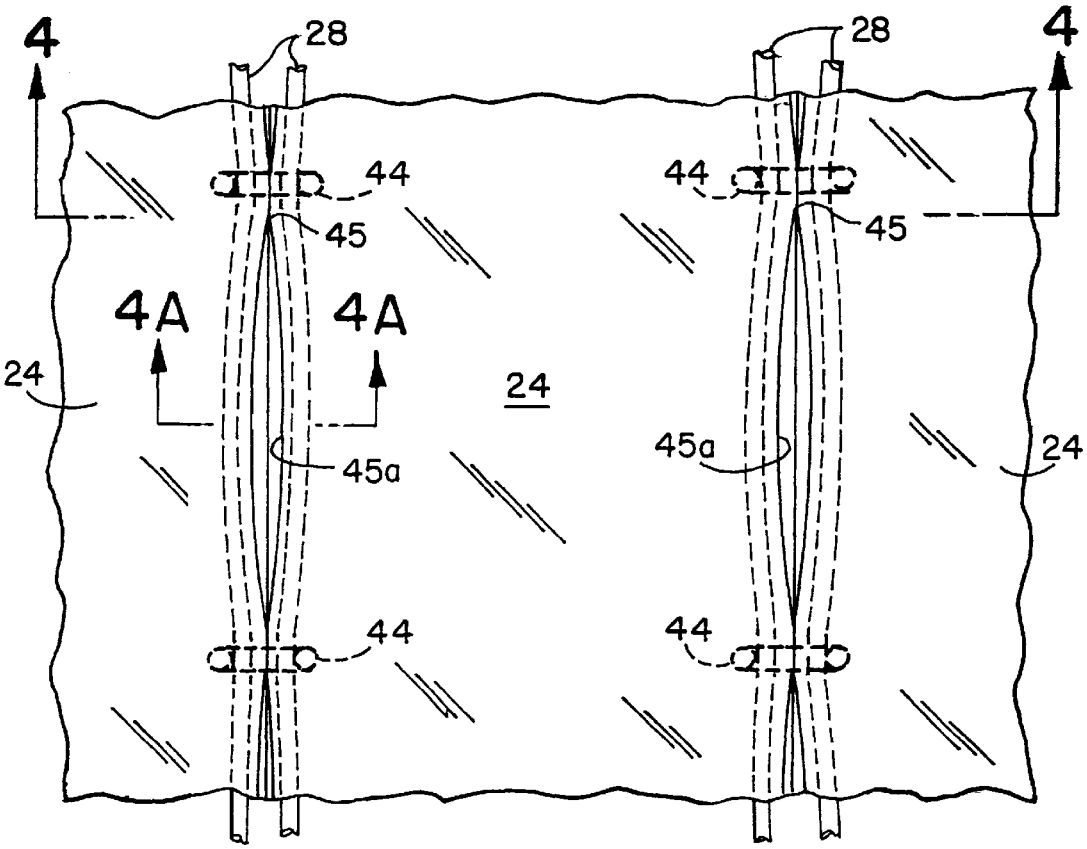
FIG. 5 is an enlarged fragmentary top plan view of the cover envelope in FIG. 4 showing the adjacent strips of cover envelope material being fastened together at spaced apart longitudinal intervals by encircling each adjacent pair of adjacent flexible reinforcing members with bendable split ring clips to clamp the adjacent reinforcing members together.

In FIGS. 4 and 5, a plurality of retaining split rings 44 are clamped around each adjacent pair of reinforcing cords 28 at spaced apart intervals along the length of the cords. This loosely holds the adjacent pairs of flaps 36 in close proximity together. When inflation air is introduced into the envelope 22 as shown in FIG. 4, the inflation pressure inside the envelope forces each adjacent pair of hanging flaps 36 together and creates a seal to retain air within the envelope without the use of adhesives, heat sealing, stitching or other sealing fastener means.

This manner of fastening together adjacent pairs of cords 28 and flaps 36 by use of the rings 44 creates a loose seam 45 in which the flaps 36 are capable of shifting movement with respect to each other to adapt to changes in wind conditions and internal pressure of the envelope.

The term "seam" as used herein means the elongated line of joinder between two adjacent edge flaps of strips of sheet material formed when the flaps are held loosely together by retaining means engaging the flaps and reinforcing members adjacent each flap.

Figure 4A:
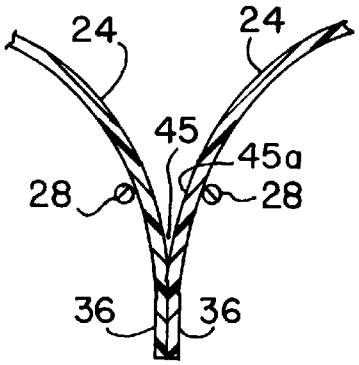
FIG. 4A is an enlarged fragmentary cross-sectional view taken on line 4A—4A of FIG. 5 at a spaced distance intermediate between locations where adjacent strips of the envelope are fasteded together.

When the envelope 22 is inflated the flaps 36 and cords 28 partially separate in the longitudinal spaced portions between the rings 44 as shown by the gaps 45*a* in FIGS. 4A and 5. This occurs due to the upward arching of the strips 24 and the cords 28 when the envelope 22 is inflated. This looseness of the seams 45 permits the strips 24 to adjust their relative joined edges to variations in exterior wind velocity while maintaining internal pressure within the envelope 22.

Referring once more to FIG. 1, due to the curved end configuration of the wall 12, it is necessary to shape the end strip 24*a* to conform to the curve and to attach the outer edge of the strip to a retaining member such as a horizontal top cord 46 extending around the curved end 48 of the wall. A horizontal extending strip 24*b* of sheet material is wrapped around the curved end 48 and is held in place by attaching it to the top cord 46 and bottom cord 49.

At the top of the wall 12, the reinforcing cords 28 are brought outside the sheets of strips 24 and are fastened to the ground by stakes 52 or other suitable means.

Figure 6:
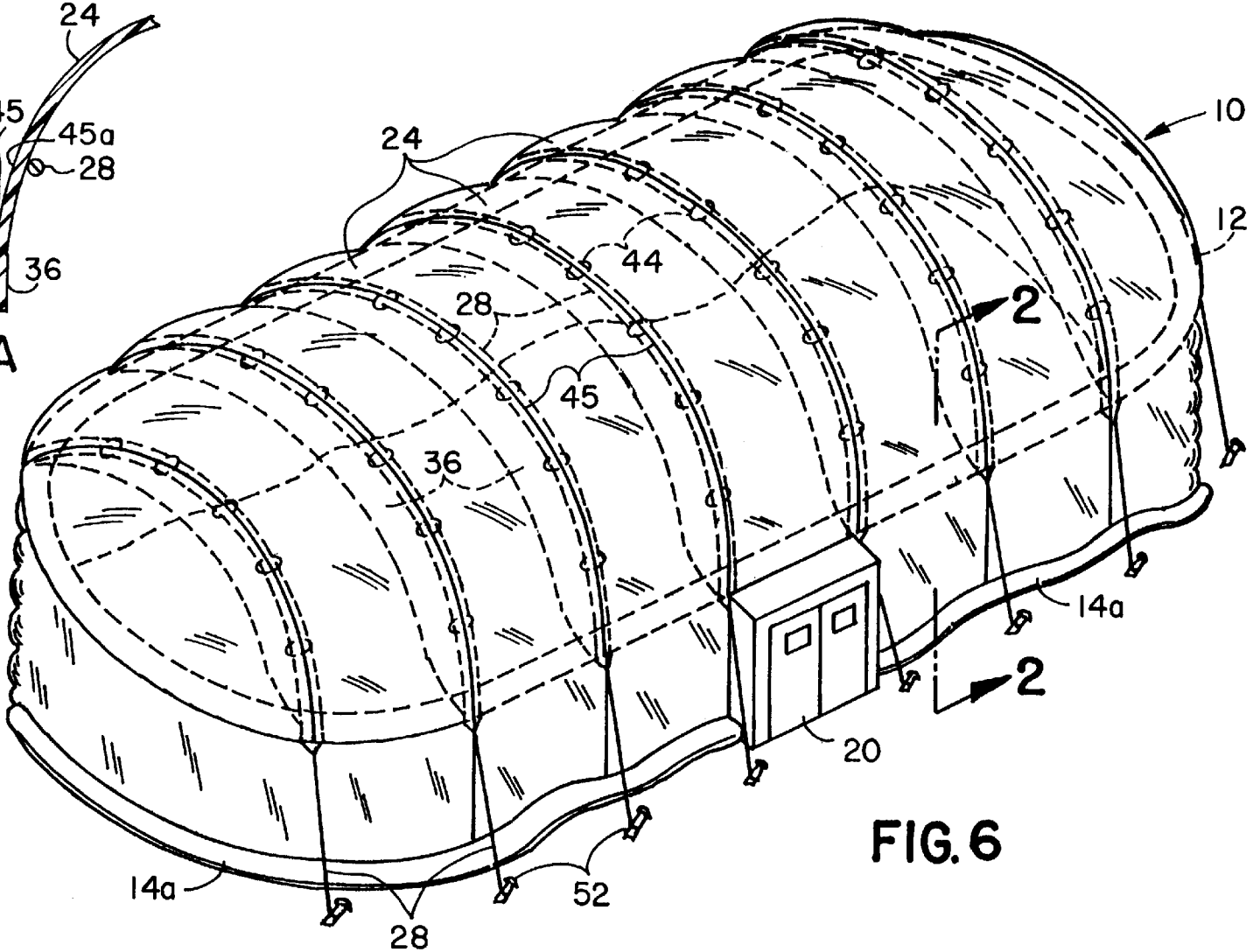
FIG. 6 is a perspective view of the enclosure of FIG. 1 after assembly has been completed and the enclosure has been inflated.

When assembly is completed and the enclosure 10 is inflated, it takes on the form shown in FIG. 6 with the strips 24 and cords 28 arching upwardly due to the internal pressure.

This structure can be operated with the envelope 22 supported by very low internal pressure which could be at less than one half the normal 0.25" of water used in present air structure technology. This results in needing much lighter blowers than those currently used.

It should be recognized that inflatable enclosures of this type can be subject to substantial variations in wind conditions which exert forces upon the envelope 22 and on the perimeter wall 12 and it is necessary at times to be able to adjust to such forces by changing the height and contour of the envelope.

Figure 7:
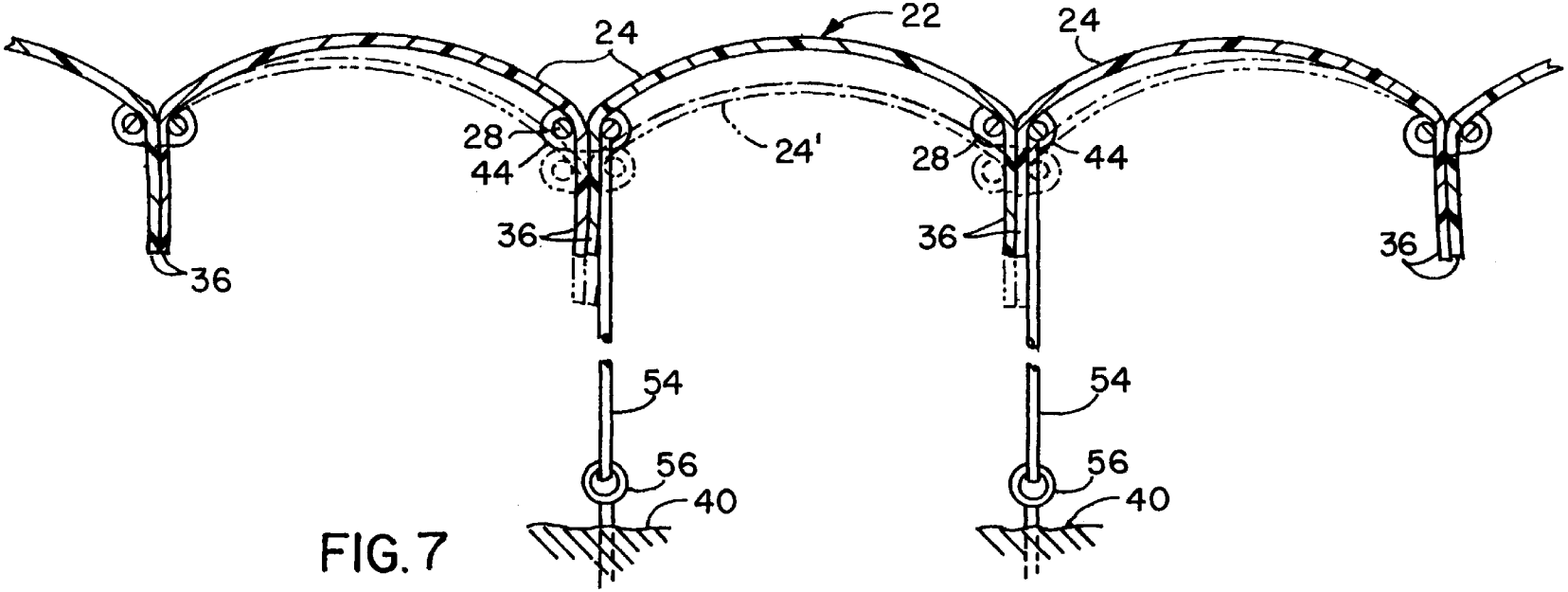
FIG. 7 is a fragmentary cross-sectional view of an inflated cover envelope showing adjustable tether means for adjusting envelope internal pressure to compensate for changes in external wind force on the envelope.

FIG. 7 shows a means of increasing internal pressure when needed by the use of vertical tethers 54 attached at the top to the envelope 22 and at the bottom to the ground 40 by a suitable anchor 56. By shortening the height of the tether 54 the strips 24 drop to the position indicated as 24' shown in chain dotted lines. By reducing the height of the envelope 22 and in turn reducing the contained volume within the envelope 22, this increases the internal pressure when needed. The tethers can also be made to shorten or lengthen automatically by connecting them to well known sensors which measure the tension on the tethers 54 and cause a reel or other device (not shown) to change slightly the length to achieve the desired tension.

Figure 8:
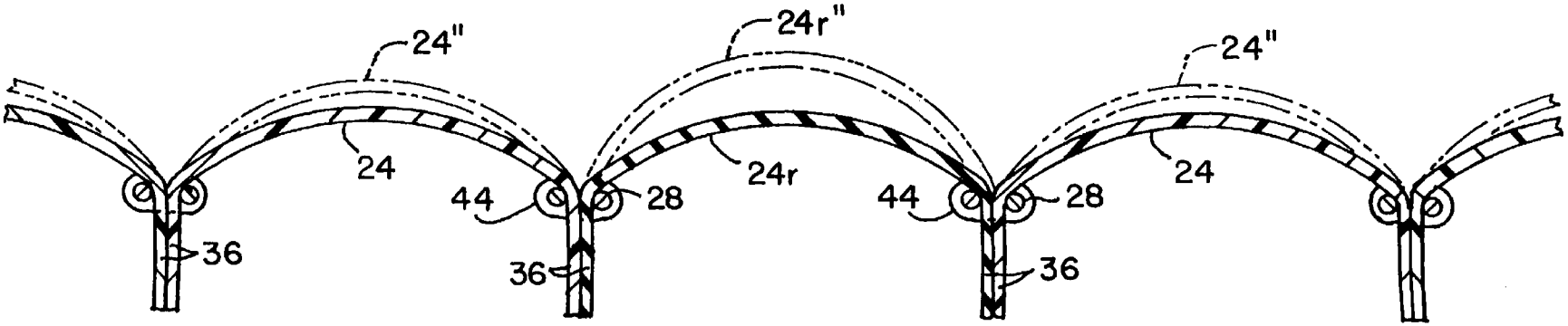
FIG. 8 is a fragmentary cross-sectional view of an inflated cover envelope showing a way of varying internal pressure within certain areas of the envelope by making some portions of the envelope with high modulus material and some portions with low modulus material.

Another means of automatically adjusting the pressure in certain areas of the envelope and hence the desired $\Delta p$, is to make some of the strips 24 of sheet material of a different modulus that others. For example in FIG. 8, strips 24 are made of plastic having one modulus and strip 24*r* is made of rubber of much lower modulus to provide for more rapid response to pressure changes in certain areas of the envelope 22. In the chain dotted lines the rubber strip 24*r*" is shown expanding more than the strips 24".

Figures 9, 10:
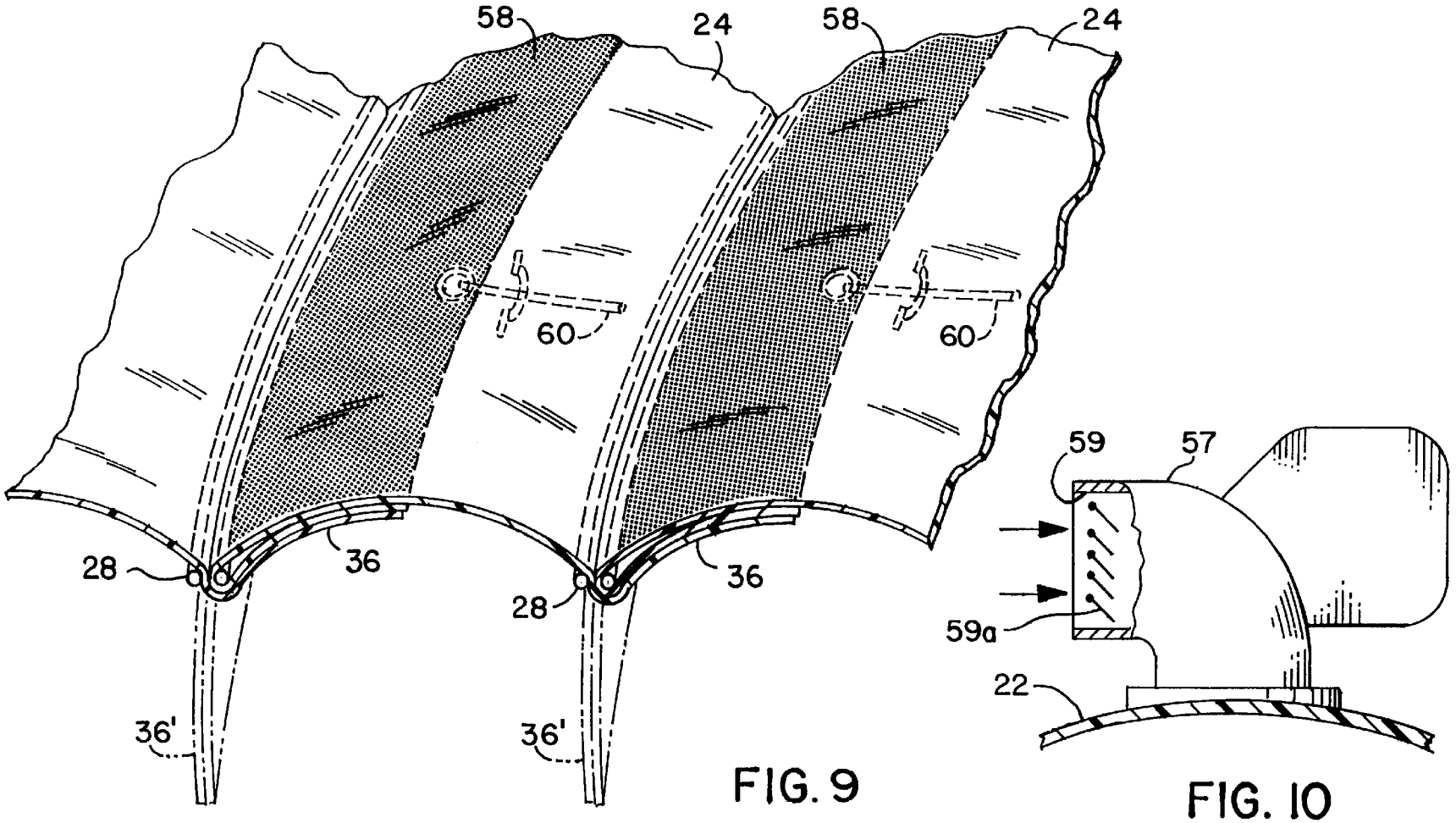
FIG. 9 is an enlarged fragmentary view of a portion of the cover envelope with interior seam flaps folded to position a heat absorbing surface to face toward the outside of the envelope.
FIG. 10 is a side elevational view of an air scoop mounted on the top of the envelope of the enclosure to bring air inside the enclosure.

Other means of automatically adjusting internal pressure within the envelope is shown in FIG. 10 in which rotatable air scoops 57 are mounted on an upper portion of the envelope 22 with an intake 59 automatically facing into the wind. When the wind reaches a certain velocity, louvers 59*a* open up in the intake opening and allow air to flow into the interior of the envelope. When the wind velocity drops below a certain level the louvers automatically drop closed to prevent air from escaping from the envelope.

Referring to FIG. 9, the present air supported structure with the hanging flaps 36 can serve a dual function in which flaps 36 not only create a flapper valve type seal between adjacent portions of the strips 24 but as shown in FIG. 9, the flaps can be used to provide heat absorption or heat reflection for light rays shining through the outside of the envelope 22. For example in FIG. 9, one side of the flaps is coated with a heat absorbing coating 58 shown by the dark shaded portions. These are activated by pull-up cords 60 which cause the flaps 36 to move from the vertical hanging position 36' to lay facing upwardly beneath the strips 24 so that the heat absorbing coating 58 absorbs the sun rays coming through the plastic sheeting which is transparent or semi-transparent and collects warmth inside the envelope. It can be readily seen that the opposite side of the hanging flaps 36 can be coated with a white heat reflective coating which performs just the opposite of the dark coating 58. The cords 60 could pull the flaps 36 in the opposite direction so that the heat reflective coating is facing upwardly to reduce the influx of heat reaching the interior of the envelope 22.

FIG. 10 shows a portion of a top of the envelope 22 with a rotatable air scoop 57 thereon having an air intake opening 59 automatically facing into the wind and having louvers 59*a* which open when the wind exceeds a certain velocity and close when the wind drops below a certain velocity so the internal air will not excap from the envelope 22.

Figure 11:
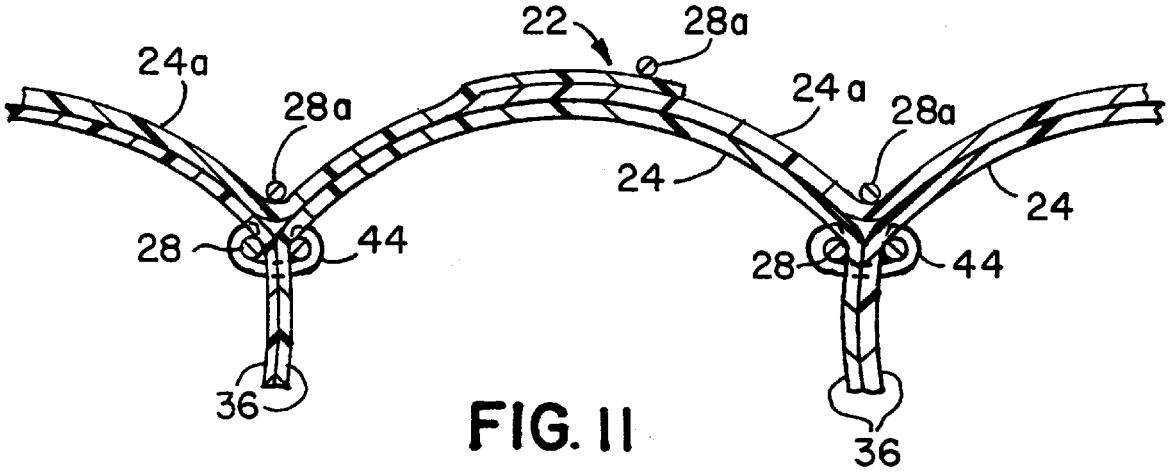
FIG. 11 is an enlarged fragmentary cross-sectional view similar to FIG. 4 but having an additional outer layer of flexible strips covering the envelope.

In some instances it may be desirable to add an additional layer of flexible strips of sheet material similar to the strips 24. FIG. 11 shows a portion of envelope 22 similar to that shown in FIG. 4 except that an additional outer layer of flexible strips 24*a* of sheet material are applied on the outer surface of the strips 24 but are offset relative to the strips 24 so that the seams or area of contact between adjacent flaps 36 are covered by the outer strips 24*a*. This overlap serves the purpose of shedding water which might accumulate in the low grooves where adjacent strips make edge contact and would prevent any such water from seeping into the enclosure 10 between adjacent flaps 36. The outer strips 24*a* may be held in place by cords 28*a* lying in the low grooves of the envelope 22 and at any exposed edges of the outer strips 24*a*. The outer strips 24*a* although shown running parallel to the strips 24, may also be applied perpendicular to the longitudinal direction of the strips 24 so that they run transversely across the strips 24.

In some instances particularly on larger enclosures it would be helpful during erection to provide a temporary hammock type structure to support the flexible strips and reinforcing members until the assembly is completed and inflation air is inserted into the envelope. This can be accomplished by a plurality of vertical internal posts across the top of which are parallel cords or cables stretched horizontally and oriented transversely to the flexible sheet material strips and the reinforcing members to support them during assembly then later removed.

Various sizes and proportions of the enclosure may be constructed and the ends may take on various configurations from that shown.

Many other variations may also be made in the structure without departing from the scope of the invention.

I claim:

1. An air supported enclosure having its lower peripheral edges attached to a base, comprising:

a flexible cover envelope comprising elongated flexible sheets arranged in parallel adjacent relationship to each other to cover the entire area to be enclosed;

a pair of parallel spaced apart flexible elongated reinforcing members positioned loosely against an inside surface of each sheet;

each reinforcing member being positioned laterally inwardly a spaced distance from a corresponding side edge of the sheet so that a center portion of each sheet lies between the pair of reinforcing members and an excess width portion of each side edge of the sheet extends over and downwardly below the respective reinforcing member to form a loosely hanging substantially vertical flap throughout the entire width of the flap;

each sheet being positioned against an adjacent sheet with each loosely hanging substantially vertical flap in intimate contact with an adjacent loosely hanging substantially vertical flap and the respective reinforcing members at each pair of adjacent flaps being in close proximity to each other separated by the two adjacent flaps;

retaining means fastening together each pair of adjacent reinforcing members at spaced intervals along the length thereof to form elongated closures between the adjacent sheets and hold each pair of adjacent flaps in contact with each other when air inflation pressure is introduced into the enclosure;

each end of the sheets and the reinforcing members being sealingly attached to a periphery of the base to form an airtight enclosure over the base; and means supplying internal inflation pressure to the interior of the enclosure in excess of atmospheric pressure;

the internal pressure forcing together adjacent surfaces of each adjacent pair of loosely hanging substantially vertical flaps to seal the elongated closures between adjacent sheets.

2. An enclosure as claimed in claim 1, including a vertical wall surrounding the perimeter, the envelope being sealingly attached to the wall.

3. An enclosure as claimed in claim 2, wherein the wall is constructed from flexible tubes filled with loose filler material to provide rigidity and weight to the wall, and wherein the wall is retained in position by rigid trusses bearing against at least the interior of the wall at spaced intervals.

4. An enclosure as claimed in claim 2, wherein the bottom of the wall is contoured to compensate for variations in grade level of the base perimeter on which the wall is constructed while maintaining a substantially even top on the wall to which the envelope and reinforcing members are attached.

5. An enclosure as claimed in claim 2 wherein the wall includes at least one access door and frame secured within the wall.

6. An enclosure as claimed in claim 1 wherein the sheets attached to the reinforcing members form a primary bottom layer of the envelope and an additional layer of similar sheets are placed on top of the bottom layer to form a secondary top layer, the sheets being located in such positions as to cover the seams of the primary bottom layer and prevent water from rain or melting snow from leaking through the seams of the envelope.

7. An enclosure as claimed in claim 1 wherein the reinforcing members with each elongated flexible sheet are made from fibrous cord.

8. An enclosure as claimed in claim 1 wherein the reinforcing members with each elongated flexible sheet are made from wire cable.

9. An enclosure as claimed in claim 1 including rotatable air scoops on the top of the enclosure which automatically face intake openings into the wind and which open only when the wind exceeds certain velocities and close when the velocity drops below a certain level so that internal air will not escape.

10. An enclosure as claimed in claim 1 including a means for controlling internal temperatures within the envelope comprising heat reflective and heat absorbent surfaces attached to the hanging flaps at each elongated closure of the envelope and means selectively folding the flaps against the inside surface of the envelope to either reflect or absorb sunlight depending upon which type of flap surface faces upwardly toward the outside of the envelope.

11. An enclosure as claimed in claim 1 including a an inner layer and an outer layer of flexible parallel sheets with the sheets of the outer layer having edges positioned laterally offset from edges of the inner layer so that the sheets of the outer layer cover the sheets of the inner layer in the area of contact between adjacent flaps of the sheets of the inner sheets.

12. An air supported enclosure having its lower peripheral edges attached to a base, comprising:

a flexible cover envelope comprising elongated flexible sheets arranged in parallel adjacent relationship to each other to cover the entire area to be enclosed;

a pair of parallel spaced apart flexible elongated reinforcing members positioned loosely against an inside surface of each sheet;

each reinforcing member being positioned laterally inwardly a spaced distance from a corresponding side edge of the sheet so that a center portion of each sheet lies between the pair of reinforcing members and an excess width portion of each side edge of the sheet extends over and downwardly below the respective reinforcing member to form a loosely hanging substantially vertical flap throughout the entire width of the flap;

each sheet being positioned against an adjacent sheet with each loosely hanging substantially vertical flap in intimate contact with an adjacent loosely hanging substantially vertical flap and the respective reinforcing members at each pair of adjacent flaps being in close proximity to each other separated by the two adjacent flaps;

retaining means fastening together each pair of adjacent reinforcing members at spaced intervals along the length thereof to form elongated closures between the adjacent sheets and hold each pair of adjacent flaps in contact with each other when air inflation pressure is introduced into the enclosure;

A wall extending around the periphery of the base and extending upwardly a predetermined distance from the base;

each end of the sheets and the reinforcing members being secured in sealing contact with a portion of the wall to form an airtight enclosure over the base; and means supplying internal inflation pressure to the interior of the enclosure in excess of atmospheric pressure;

the internal pressure forcing together adjacent surfaces of each adjacent pair of loosely hanging substantially vertical flaps to seal the elongated closures between adjacent sheets.

13. An enclosure as claimed in claim 12 wherein the vertical wall is constructed of a plurality of tubular members filled with loose filler material, said tubular members being stacked in a vertical row to obtain a desired wall height.

14. An enclosure as claimed in claim 13 including a plurality of rigid trusses bearing against at least the interior of the wall to provide stability.

15. An enclosure as claimed in claim 12 wherein the flexible sheets extend downwardly over the outside surface of the vertical wall and are sealingly retained against the base at the bottom of the wall.

* * * * *